US009864313B2

(12) United States Patent
Soshi et al.

(10) Patent No.: US 9,864,313 B2
(45) Date of Patent: Jan. 9, 2018

(54) FIXING DEVICE AND IMAGE FORMING APPARATUS

(71) Applicant: FUJI XEROX CO., LTD., Tokyo (JP)

(72) Inventors: Kyogo Soshi, Kanagawa (JP); Kiyoshi Iwai, Kanagawa (JP); Yasutaka Gotoh, Kanagawa (JP); Sou Morizaki, Kanagawa (JP); Jouta Kobayashi, Kanagawa (JP); Hiroko Furukata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/244,079

(22) Filed: Aug. 23, 2016

(65) Prior Publication Data

US 2017/0255145 A1 Sep. 7, 2017

(30) Foreign Application Priority Data

Mar. 4, 2016 (JP) ..... 2016-042314

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/2064; G03G 15/2089
See application file for complete search history.

(56) References Cited

U.S. PATENT DOCUMENTS

2006/0210331 A1* 9/2006 Baba ..... G03G 15/2053 399/329
2011/0262193 A1 10/2011 Kimura
2015/0253707 A1 9/2015 Suzuki et al.

FOREIGN PATENT DOCUMENTS

JP 2011-227377 A 11/2011
JP 2015-169893 A 9/2015

* cited by examiner

*Primary Examiner* — Hoang Ngo
(74) *Attorney, Agent, or Firm* — Sughrue Mion, PLLC

(57) ABSTRACT

A fixing device includes a first belt that heats a developer image on a recording medium; a support member that is arranged inside the first belt and supports the first belt; a second belt that sandwiches the recording medium with the first belt; a pressing roller that is provided with the second belt having an inner peripheral surface wound thereon, is provided rotatably in a direction orthogonal to a recording-medium transport direction as an axial direction, presses the second and first belts toward the support member, and forms a first press region; and a forming member that is provided inside the second belt, at an upstream side in the transport direction with respect to the pressing roller, presses the second and first belts toward the support member, and forms a second press region having a larger width than that of the first press region in the transport direction.

10 Claims, 9 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2016-042314 filed Mar. 4, 2016.

BACKGROUND

The present invention relates to a fixing device and an image forming apparatus.

SUMMARY

According to an aspect of the invention, there is provided a fixing device including a first belt that heats a developer image on a recording medium; a support member that is arranged inside the first belt and supports the first belt; a second belt that sandwiches the recording medium with the first belt; a pressing roller that is provided with the second belt having an inner peripheral surface wound around the pressing roller, is provided rotatably in a direction orthogonal to a transport direction of the recording medium as an axial direction, presses the second belt and the first belt toward the support member, and hence forms a first press region; and a forming member that is provided inside the second belt, at an upstream side in the transport direction with respect to the pressing roller, presses the second belt and the first belt toward the support member, and hence forms a second press region having a larger width than a width of the first press region in the transport direction.

BRIEF DESCRIPTION OF THE DRAWINGS

Exemplary embodiments of the present invention will be described in detail based on the following figures, wherein.

DETAILED DESCRIPTION

First Exemplary Embodiment

Examples of a fixing device and an image forming apparatus according to a first exemplary embodiment are described.

General Configuration

Figure 1:
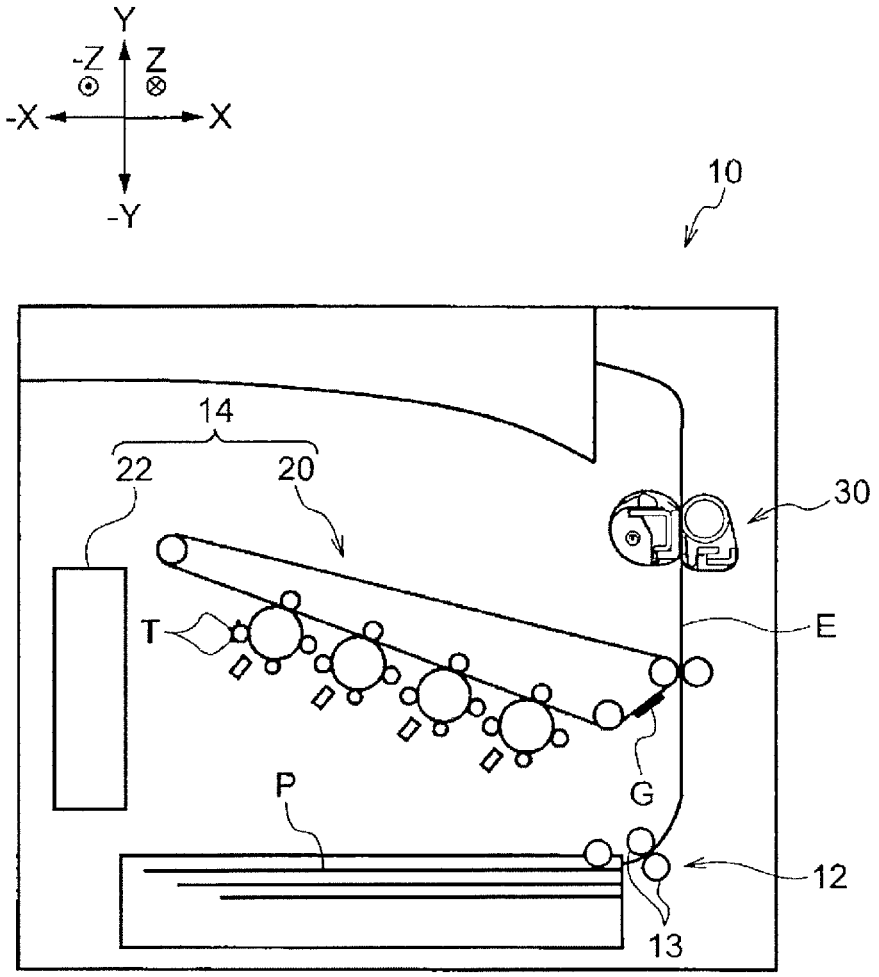
FIG. 1 is a configuration diagram showing an image forming apparatus according to a first exemplary embodiment.

FIG. 1 illustrates an image forming apparatus 10 according to the first exemplary embodiment. For example, the image forming apparatus 10 includes a transport section 12 having a roller pair 13 that transports a sheet of paper P, an image forming section 14 that forms a toner image G on the sheet P transported by the transport section 12 with use of a toner T, and a fixing device 30 that fixes the toner image G to the sheet P by heating and pressing the toner image G. The sheet P is an example of a recording medium. The toner T is an example of a developer. The toner image G is an example of a developer image. The image forming section 14 is an example of a developer image forming unit.

In the following description, it is assumed that a direction indicated by arrow Y in FIG. 1 represents an apparatus height direction, and a direction indicated by arrow X in FIG. 1 represents an apparatus width direction. Also, it is assumed that a direction (indicated by Z) orthogonal to the apparatus height direction and the apparatus width direction represents an apparatus depth direction. In front view of the image forming apparatus 10, the apparatus height direction, the apparatus width direction, and the apparatus depth direction are written as Y direction, X direction, and Z direction. Further, if one side and the other side of each of the X direction, Y direction, and Z direction are required to be distinguished from each other, in front view of the image forming apparatus 10, the upper side is written as Y side, the lower side is written as −Y side, the right side is written as X side, the left side is written as −X side, the deep side is written as Z side, and the near side is written as −Z side. A transport path E of the sheet P extends along, for example, the Y direction.

The image forming section 14 includes an image forming unit 20, and a controller 22 that controls operation of respective portions of the image forming unit 20 and causes the image forming unit 20 to form a toner image G on a sheet P. The image forming unit 20 executes, for example, respective processes of charge with electricity, exposure to light, development, and transfer, which are included in a known electrophotographic system.

Major Section Configuration

The fixing device 30 is described next.

Figure 2:
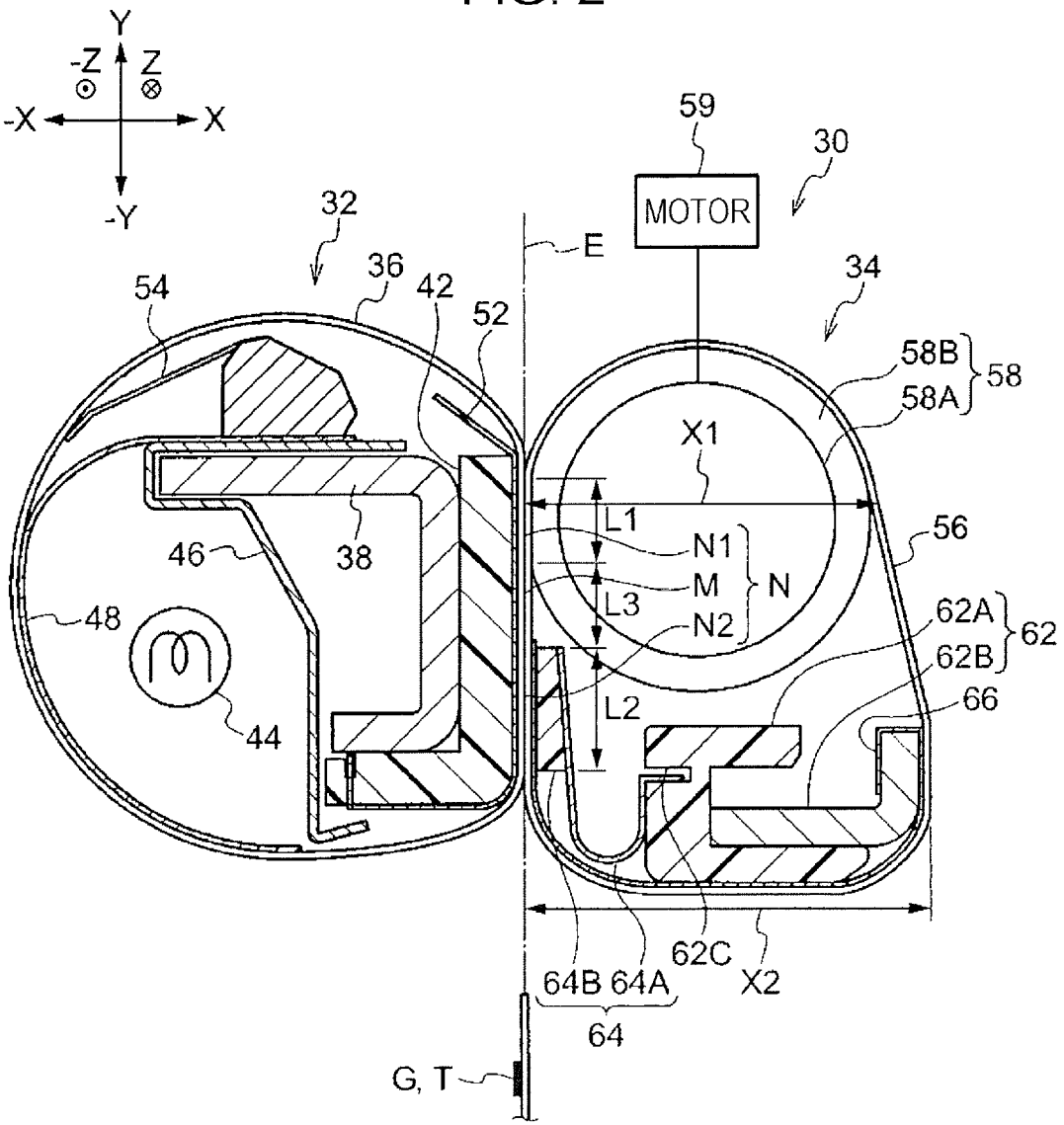
FIG. 2 is an explanatory view showing a configuration of a fixing device according to the first exemplary embodiment.

The fixing device 30 shown in FIG. 2 includes a heating unit 32 that is provided at the −X side with respect to the transport path E of the sheet P and heats the toner image G, and a pressing unit 34 that is provided at the X side with respect to the transport path E and presses the sheet P and the toner image G toward the heating unit 32. In this exemplary embodiment, for example, the transport direction of the sheet P in the fixing device 30 is the Y direction as described above, and the width direction of the sheet P orthogonal to the Y direction is the Z direction.

A part at which the outer peripheral surface of a fixing belt 36 (described later) and the outer peripheral surface of a pressing belt 56 (described later) sandwich the sheet P, and at which the toner image G (the toner T) on the sheet P is heated and pressed is called nip part N. In this exemplary embodiment, for example, the nip part N is formed linearly along the Y direction when viewed in the Z direction.

Heating Unit

The heating unit 32 includes the fixing belt 36, a holder 38, a pad 42, a halogen lamp 44, a reflecting member 46, a heat transfer member 48, a slide sheet 52, and a thermistor 54. The fixing belt 36 is an example of a first belt. The pad 42 is an example of a support member.

Fixing Belt

The fixing belt 36 is an endless belt having a larger width in the Z direction than the width of the sheet P. For example, the fixing belt 36 includes a base layer and a mold release layer covering the outer peripheral surface of the base layer. The material of the base layer may be a polymer, such as polyimide, polyamide, or polyimideamide; or a metal, such as stainless steel, nickel, or copper. In this exemplary embodiment, for example, polyimide is used. The mold release layer is made of, for example, tetrafluoroethylene-perfluoalkylvinylether copolymer (PFA).

Also, the fixing belt 36 is arranged rotatably (turnably) around the Z direction as its axial direction, at the −X side with respect to the transport path E of the sheet P. To be specific, the fixing belt 36 is sandwiched between the pressing belt 56 (described later) and the slide sheet 52 (the pad 42). The fixing belt 36 is rotated by the rotation of a pressing roller 58 and the movement of the pressing belt 56. Further, the fixing belt 36 plots a movement locus close to a semicircle by the rigidity against an external force acting toward the inside of the fixing belt 36 in an area except the nip part N.

Also, the outer peripheral surface of the fixing belt 36 contacts the toner image G on the sheet P transported through the transport path E. The fixing belt 36 is heated by the heat transfer member 48 (described later), and hence heats the toner image G on the sheet P. At both end portions of the fixing belt 36, guide members (not shown) that restrict meandering of the fixing belt 36 in the Z direction are provided.

Holder

The holder 38 is a long member that is made of a sheet metal and is longer than the width of the fixing belt 36 in the Z direction. The holder 38 has a J-shaped X-Y cross section. Also, the holder 38 is arranged inside the fixing belt 36 in a state open to the −X side. The holder 38 is supported by a bracket (not shown).

Pad

For example, the pad 42 is a resin member made of polyethylene terephthalate (PET), and is as substantially long as the width in the Z direction of the fixing belt 36. Also, the pad 42 has an L-shaped X-Y cross section. Further, the pad 42 is arranged inside the fixing belt 36, and is fixed at the X side of a wall portion extending along the Y direction of the holder 38. In addition, the slide sheet 52 (described later) is in contact with the surface at the X side of the pad 42. An end portion at the −Y side (the entry side of the sheet P) of the pad 42 has a round shape to protrude toward the fixing belt 36. The pad 42 indirectly supports the fixing belt 36.

Halogen Lamp

The halogen lamp 44 is provided inside the fixing belt 36, at the −X side with respect to the reflecting member 46 (described later), in a non-contact manner with the reflecting member 46. The halogen lamp 44 has its longitudinal direction in the Z direction. A light emitting portion of the halogen lamp 44 has a length in the Z direction being substantially the same as the length in the Z direction of a sheet P with the maximum width among sheets P to be used in the image forming apparatus 10 (see FIG. 1). The halogen lamp 44 is tuned on by energization from a power supply (not shown) and radiates radiation heat (light).

Reflecting Member

The reflecting member 46 is a member formed by bending a sheet material, having its longitudinal direction in the Z direction, at plural positions in the short-side direction. The reflecting member 46 is arranged to cover the −X side of the holder 38, and faces the halogen lamp 44. The reflecting member 46 reflects the light of the halogen lamp 44 to the side opposite to the nip part N side (to the −X side).

Heat Transfer Member

The heat transfer member 48 is a member having a larger length in the Z direction than the length in the Z direction of the fixing belt 36. The heat transfer member 48 is arranged inside the fixing belt 36, at the −X side with respect to the halogen lamp 44. Also, the heat transfer member 48 is curved in a C shape open to the X side when viewed in the Z direction. One end portion of the heat transfer member 48 is fixed to the holder 38 together with the reflecting member 46. A curved portion curved from the center to the other end of the heat transfer member 48 is in contact with the inner peripheral surface of the fixing belt 36. The heat transfer member 48 absorbs the radiation heat of the halogen lamp 44 and transfers the heat to the fixing belt 36 in a contact state with the fixing belt 36.

Slide Sheet

The slide sheet 52 is fixed to the pad 42 to cover the surface at the X side of the pad 42. Also, the slide sheet 52 is sandwiched between the fixing belt 36 and the pad 42 when the fixing belt 36 is pressed by the pressing unit 34. Further, the slide sheet 52 is formed of a material so that the friction coefficient between the fixing belt 36 and the slide sheet 52 is smaller than the friction coefficient between the fixing belt 36 and the pad 42.

Thermistor

The thermistor 54 is fixed to the holder 38 inside the fixing belt 36, and includes a detector that detects the temperature. The detector is in contact with the inner peripheral surface of the fixing belt 36. The controller 22 (see FIG. 1) energizes the halogen lamp 44 if the temperature detected by the thermistor 54 is lower than a set temperature of the fixing device 30, and stops the energization to the halogen lamp 44 if the detected temperature is higher than the set temperature. The set temperature is a temperature at which the toner image G is able to be fixed to the sheet P. Hereinafter, the set temperature is referred to as fixing temperature.

Pressing Unit

The pressing unit 34 includes, for example, the pressing belt 56, the pressing roller 58, a motor 59, a holder 62, a forming member 64, and a slide sheet 66. The pressing belt 56 is an example of a second belt. The motor 59 is an example of a driving source.

Pressing Belt

The pressing belt 56 is an endless belt having a larger width in the Z direction than the width of the sheet P. For example, the pressing belt 56 includes a base layer and a mold release layer covering the outer peripheral surface of the base layer. The material of the base layer may be a polymer, such as polyimide, polyamide, or polyimideamide; or a metal, such as stainless steel, nickel, or copper. In this exemplary embodiment, for example, polyimide is used. The mold release layer is made of, for example, PFA.

Also, the pressing belt 56 is arranged rotatably (turnably) around the Z direction as its axial direction, at the X side with respect to the transport path E of the sheet P. To be specific, the pressing belt 56 is sandwiched between the fixing belt 36, and the pressing roller 58 (described later) and the slide sheet 66 (the forming member 64). The pressing belt 56 is rotated by the rotation of the pressing roller 58. Further, the pressing belt 56 is wound around the pressing roller 58 and the holder 62, and is in contact with the forming member 64.

In addition, the pressing belt 56 forms a nip part N at which the pressing belt 56 sandwiches the sheet P with the fixing belt 36 as described above. The outer peripheral surface of the pressing belt 56 contacts a surface of the sheet P at the side opposite to the toner image G side of the sheet P transported through the transport path E. The pressing belt 56 is pressed by the pressing roller 58 and the forming member 64, and hence presses the toner image G on the sheet P.

Pressing Roller

The pressing roller 58 is arranged inside the pressing belt 56, at the Y side (the downstream side in the transport direction of the sheet P). The inner peripheral surface of the pressing belt 56 is wound around a portion of the outer periphery of the pressing roller 58. Further, the pressing roller 58 includes a columnar core metal 58A having its axial direction in the Z direction, and an elastic layer 58B formed on the outer peripheral surface of the core metal 58A. The elastic layer 58B is made of, for example, silicon rubber. The core metal 58A is rotated (driven) by the motor 59 (described later).

Both end portions in the axial direction of the core metal 58A are rotatably supported by bearings mounted on brackets (not shown). Also, the core metal 58A is pushed by a spring (not shown) toward the pressing belt 56 so that the outer peripheral surface of the elastic layer 58B contacts the inner peripheral surface of the pressing belt 56 and hence forms a first press region N1. As described above, the pressing roller 58 is provided rotatably around the Z direction orthogonal to the transport direction of the sheet P as its axial direction, presses the pressing belt 56 and the fixing belt 36 toward the pad 42, and hence forms the first press region N1.

The first press region N1 is a region being a portion of the aforementioned nip part N. The first press region N1 forms a downstream-side portion of the nip part N (an output-side portion of the sheet P) in the transport direction of the sheet P (the Y direction). It is assumed that L1 denotes a width in the Y direction of the first press region N1. The length of a portion of the pressing belt 56 wound around the pressing roller 58 has a larger length in the circumferential direction than the length of the first press region N1.

Motor

The motor 59 is controlled to be rotated and stopped by the controller 22 (see FIG. 1). Also, the motor 59 is connected with the core metal 58A through a gear (not shown).

Holder

The holder 62 includes, for example, a body portion 62A made of resin, and a mount portion 62B made of a sheet metal. The mount portion 62B is fixed to the body portion 62A, and is supported by a bracket (not shown). Also, the holder 62 is arranged at a position inside the pressing belt 56, at the −Y side (the upstream side in the transport direction of the sheet P), and at the X side. A portion of the slide sheet 66 (described later) is wound around a surface at the −Y side of the body portion 62A and a surface at the X side of the mount portion 62B. A recessed portion 62C is formed in a portion at the −X side of the body portion 62A. The recessed portion 62C is open to the −X side.

Forming Member

The forming member 64 is provided, for example, inside the pressing belt 56, at the upstream side (the −Y side) in the transport direction of the sheet P with respect to the pressing roller 58. The forming member 64 includes a leaf spring portion 64A and a pad portion 64B extending in the Z direction as the longitudinal direction. The leaf spring portion 64A is formed in a U shape open to the Y side when viewed in the Z direction. One end portion at the X side of the leaf spring portion 64A is mounted at the recessed portion 62C of the holder 62.

The pad portion 64B is, for example, a plate-shaped member made of polyethylene terephthalate (PET). Also, the pad portion 64B is fixed to the other end portion at the −X side of the leaf spring portion 64A. By applying an elastic force toward the −X side form the leaf spring portion 64A, the pressing belt 56 and the fixing belt 36 are pushed toward the pad 42 through the slide sheet 66 (described later). That is, the forming member 64 presses the pressing belt 56 and the fixing belt 36 toward the pad 42, and hence forms a second press region N2.

The second press region N2 is a region being a portion of the aforementioned nip part N. The second press region N2 forms an upstream-side portion of the nip part N (an entry-side portion of the sheet P) in the transport direction of the sheet P. Also, a width L2 of the second press region N2 in the transport direction of the sheet P (the Y direction) is larger than the width L1 of the aforementioned first press region N1 in the Y direction. A region between the first press region N1 and the second press region N2 in the nip part N is referred to as intermediate region M.

In the intermediate region M, the fixing belt 36 is supported by the pad 42 from the inner side, and the pressing belt 56 is not supported from the inner side. Hence, almost no pressing force acts on the sheet P in the intermediate region M. However, since the pressing belt 56 has a tension by pressing in the first press region N1 and pressing in the second press region N2, the sheet P is hardly bent. A width L3 in the Y direction of the intermediate region M is smaller than the width L1 in the Y direction of the first press region N1.

Although not shown, regarding a force per unit area acting on the sheet P in the nip part N, it is assumed that PS1 is a pressing force in the first press region N1, PS2 is a pressing force in the second press region N2, and PS3 is a pressing force in the intermediate region M. In this exemplary embodiment, for example, a relationship of PS1>PS2>PS3 is established.

Slide Sheet

The slide sheet 66 is formed of a material so that the friction coefficient between the pressing belt 56 and the slide sheet 66 is smaller than the friction coefficient between the pressing belt 56 and the pad portion 64B. Also, the slide sheet 66 is wound around the holder 62 and the pad portion 64B. Further, the pressing belt 56 is wound around the slide sheet 66.

In this exemplary embodiment, a width X2 in the X direction at the forming member 64 side of the pressing belt 56 is larger than a width X1 in the X direction at the pressing roller 58 side of the pressing belt 56. Accordingly, since the space for arranging the forming member 64 is ensured, the forming member 64 may be changed to a large member having a strong pushing force, and hence a pressing force (pushing force) in the second press region N2 is ensured.

Comparative Example

A configuration in which the width L1 of the first press region N1 is larger than the width L2 of the second press region N2 serves as a fixing device according to a comparative example. In the fixing device of the comparative example, when the width of the first press region N1 is increased to increase the total width of the width L1 and the width L2, the width L1 is not increased unless the elastic layer 58B (the outer peripheral portion) of the pressing roller 58 is further depressed. However, if the elastic layer 58B of the pressing roller 58 is excessively depressed, the peripheral velocity of the pressing belt 56 is easily varied at the boundary between the portion of the first press region N1 and the portion other than the first press region N1. As the result, transport performance of the sheet P may be decreased. As described above, there is scope for improvement to increase the total width of the width L1 and the width L2 in the fixing device according to the comparative example.

Operation

Operation According to the First Exemplary Embodiment is Described Next.

In the image forming apparatus 10 shown in FIG. 1, rising operation of the fixing device 30 is started in synchronization with formation of a toner image G on a sheet P by the image forming section 14. To be specific, in the fixing device 30 shown in FIG. 2, the halogen lamp 44 is turned on, and the motor 59 drives the pressing roller 58. Then, by the rotation of the pressing roller 58, the pressing belt 56 starts turning, and the fixing belt 36 starts turning (being rotated). At this time, in a portion of the fixing belt 36 at the side opposite to the nip part N side, the heat transfer member 48 heated by the halogen lamp 44 contacts the inner peripheral surface of the fixing belt 36, hence the fixing belt 36 is heated, and the temperature of the fixing belt 36 becomes the fixing temperature. In the nip part N, the toner image G on the transported sheet P is heated and pressed, and hence fixed to the sheet P.

Figure 3A:
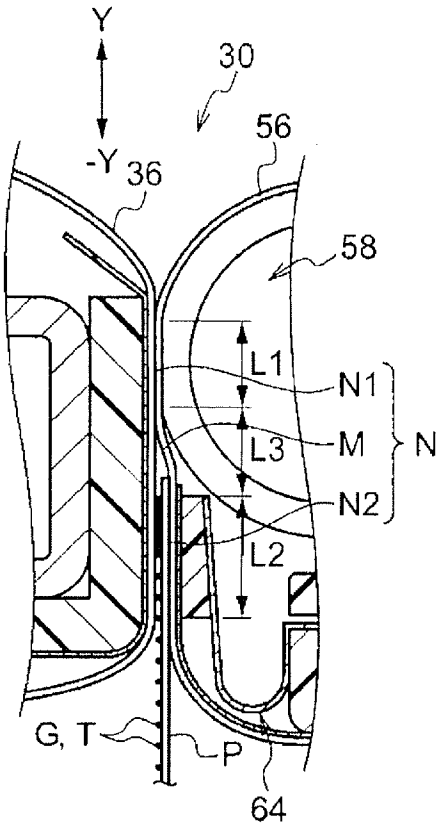
FIGS. 3A to 3C are explanatory views each showing a process of fixing a toner image at a nip part of the fixing device according to the first exemplary embodiment.

To be specific, as shown in FIG. 3A, the toner image G on the sheet P entering the nip part N is heated and molten by the fixing belt 36, and starts being pressed with a pressing force by the forming member 64 in the second press region N2.

Figure 3B:
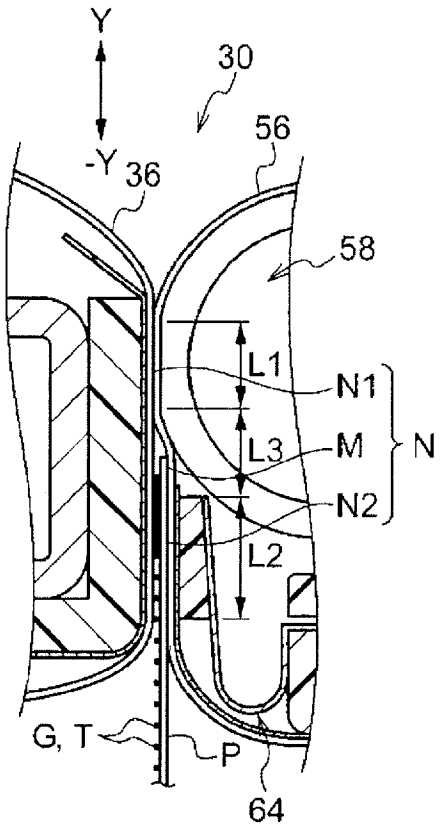

Then, as shown in FIG. 3B, the toner image G on the sheet P passing through the second press region N2 and entering the intermediate region M is heated by the fixing belt 36, and the melting progresses.

Figure 3C:
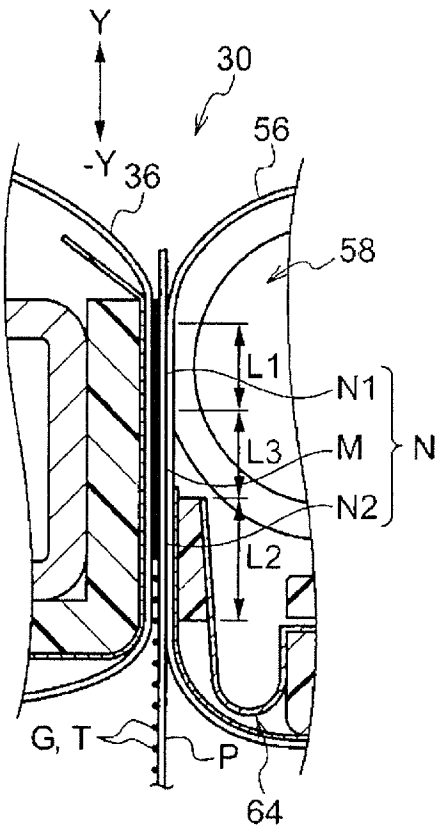

Then, as shown in FIG. 3C, the toner image G on the sheet P entering the first press region N1 from the intermediate region M is heated and molten by the fixing belt 36, and pressed with a pressing force by the pressing roller 58 in the first press region N1. In this way, the toner image G on the sheet P is fixed to the sheet P by heating in the three steps and pressing in the two steps.

In the fixing device 30 shown in FIG. 2, the second press region N2 having the larger width in the Y direction than the width of the first press region N1 using the pressing roller 58 is arranged at the upstream side of the nip portion N. Hence, the total width of the width L1 and the width L2 is increased by the second press region N2 using the forming member 64, without excessive depression of the elastic layer 58B of the pressing roller 58 in the first press region N1. That is, the total width of the first press region N1 and the second press region N2 is increased without excessive depression of the pressing roller 58 as compared with the configuration in which the width L2 is smaller than the width L1 in the Y direction.

Also, in the fixing device 30, since the pressing roller 58 is not excessively depressed, the difference between the radius of the pressed portion and the radius of the non-pressed portion of the elastic layer 58B of the pressing roller 58 is smaller than that of the configuration in which the pressing roller 58 is excessively depressed. Accordingly, the variation in peripheral velocity at a position near the boundary between the pressed portion and the non-pressed portion while the pressing roller 58 is rotated is decreased. Hence, variation in velocity of the sheet P when the sheet P enters the first press region N1 is restricted, and misregistration of the toner image G on the sheet P is restricted.

Further, in the fixing device 30, the width of the region where the toner image G on the sheet P entering the nip part N is heated and pressed is increased toward the upstream side of the nip part N. Hence, the period of time for heating and pressing the toner image G may be set long until the sheet P enters the intermediate region M where the smallest pressing force acts on the sheet P. Accordingly, since the amount of the toner image G, which is not sufficiently fixed to the sheet P and enters the intermediate region M, is decreased. Misregistration of the toner image G in the intermediate region M is restricted.

In addition, in the fixing device 30, the width in the Y direction of the nip part N is a width (L1+L2+L3) equal to or larger than the total width of the width L1 of the first press region N1 and the width L2 of the second press region N2. Hence, the width in the Y direction of the nip part N is further increased as compared with a configuration that fixes a toner image G by using a pair of rollers. Accordingly, the toner image G may be fixed to the sheet P even if the fixing temperature is set low, as compared with the configuration that fixes the toner image G by using the pair of rollers.

Also, in the fixing device 30, since the pressing belt 56 is used in addition to the fixing belt 36, the sheet P is supported by the pressing belt 56 in the intermediate region M between the first press region N1 and the second press region N2. Hence, a bend of the sheet P in the intermediate region M is restricted as compared with a configuration without the pressing belt 56.

Further, in the fixing device 30, the pressing belt 56 is wound around the pressing roller 58 in an area larger than the first press region N1 among the outer peripheral surface of the pressing roller 58. Hence, even if the width of the first press region N1 in the Y direction is decreased, the pressing belt 56 may be driven by the rotation of the pressing roller 58, and a slip in the moving direction of the pressing belt 56 is restricted.

In the image forming apparatus 10 (see FIG. 1), the toner image G may be fixed to the sheet P even if the fixing temperature is set low in the fixing device 30 as described above, and hence energy may be saved in the image forming apparatus 10 as compared with a configuration without the fixing device 30.

Second Exemplary Embodiment

Examples of a fixing device and an image forming apparatus according to a second exemplary embodiment are described. The same reference signs as those of the first exemplary embodiment are applied to the basically same members and portions as those of the first exemplary embodiment, and redundant description is omitted.

Figure 4:
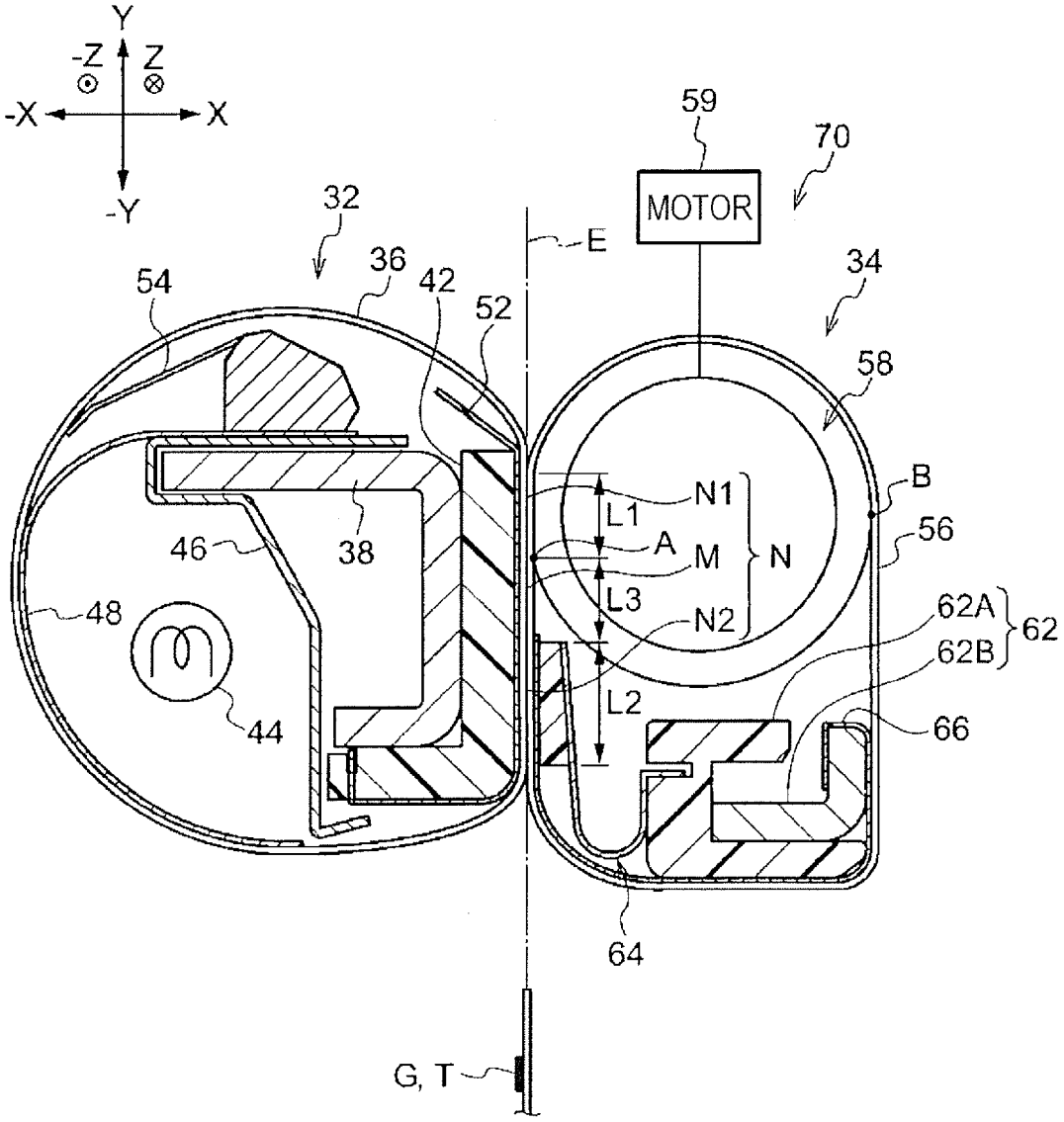
FIG. 4 is an explanatory view showing a configuration of a fixing device according to a second exemplary embodiment.

FIG. 4 illustrates a fixing device 70 according to the second exemplary embodiment. The fixing device 70 differs from the fixing device 30 (see FIG. 2) according to the first exemplary embodiment in that the length in the X direction of the mount portion 62B is decreased. Also, in the fixing device 70, the length by which the pressing belt 56 is wound around the pressing roller 58 in the circumferential direction of the pressing roller 58 is at least ½ or about ½ of the peripheral length of the pressing roller 58. The length by which the pressing belt 56 is wound around the pressing roller 58 is a length from a position A corresponding to the entrance of the first press region N1 on the outer peripheral surface of the pressing roller 58 to a position B at which the pressing belt 56 is separated from the pressing roller 58 in FIG. 4.

Operation

Operation according to the second exemplary embodiment is described next.

In the fixing device 70 shown in FIG. 4, the length from the position A to the position B is at least ½ or about ½ of the peripheral length of the pressing roller 58. Accordingly, as compared with a configuration in which the wound length of the pressing belt 56 around the pressing roller 58 is smaller than ½ or about ½, the contact area between the pressing roller 58 and the pressing belt 56 is increased, and hence a slip (driving defect) of the pressing belt 56 when the pressing roller 58 is rotated is restricted.

The present invention is not limited to the above-described exemplary embodiments.

First Modification

Figure 5:
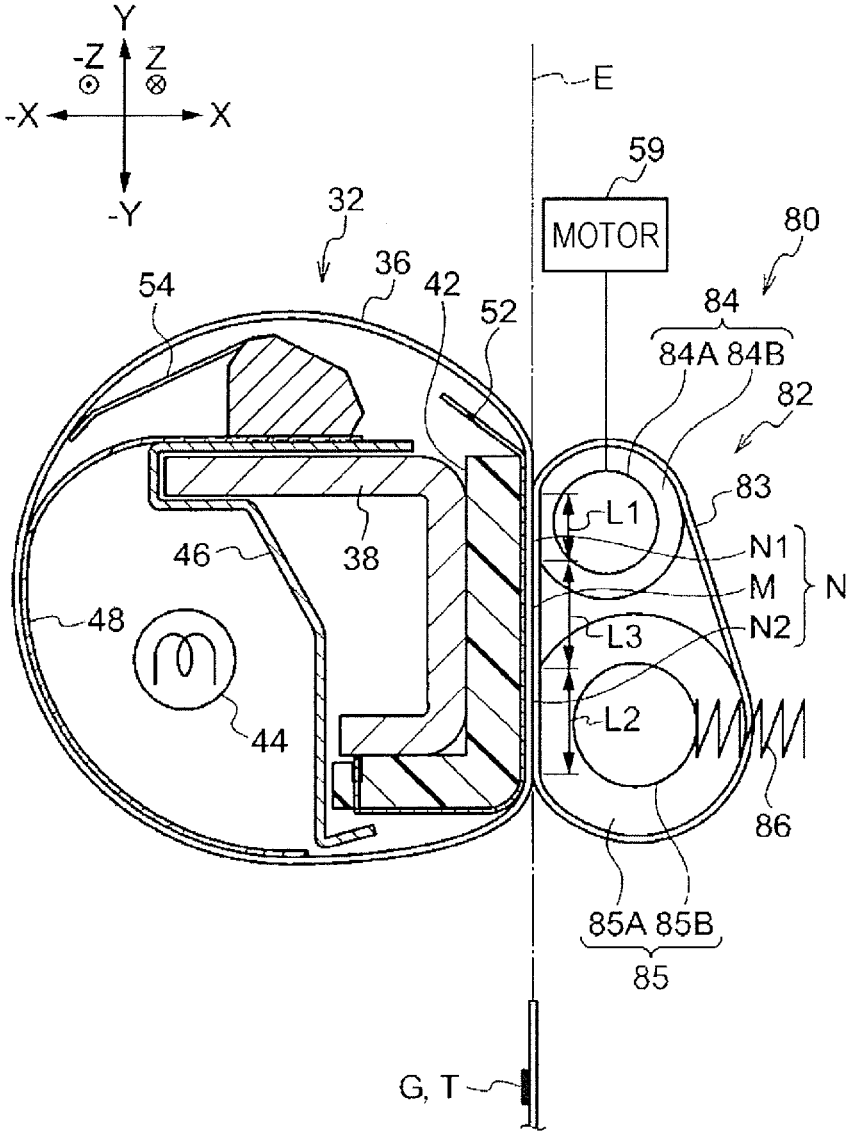
FIG. 5 is an explanatory view showing a configuration of a fixing device according to a first modification.

FIG. 5 illustrates a fixing device 80 according to a first modification. The fixing device 80 differs from the fixing device 30 (see FIG. 2) according to the first exemplary embodiment in that a pressing unit 82 is provided instead of the pressing unit 34 (see FIG. 2). The pressing unit 82 includes a pressing belt 83, a pressing roller 84, the motor 59, a pushing roller 85, and a spring member 86. The pressing belt 83 is an example of a second belt. The pushing roller 85 and the spring member 86 are an example of a forming member.

The pressing belt 83 is configured similarly to the above-described pressing belt 56 (see FIG. 2). However, the pressing belt 83 has a smaller peripheral length than that of the pressing belt 56. Also, the pressing belt 83 forms a nip part N at which the pressing belt 83 sandwiches the sheet P with the fixing belt 36.

The pressing roller 84 is arranged inside the pressing belt 83, at the Y side (the downstream side in the transport direction of the sheet P). Also, the pressing belt 83 is wound around a portion of the outer periphery of the pressing roller 84. Further, the pressing roller 84 includes a columnar core metal 84A having its axial direction in the Z direction, and a rubber layer 84B formed on the outer peripheral surface of the core metal 84A. The core metal 84A is rotatably supported by a bearing (not shown). Also, the core metal 84A is rotated when driven by the motor 59. The pressing roller 84 presses the pressing belt 83 and the fixing belt 36 toward the pad 42, and hence forms a first press region N1.

The pushing roller 85 is arranged inside the pressing belt 83, at the −Y side (the upstream side in the transport direction of the sheet P). Also, the pressing belt 83 is wound around a portion of the outer periphery of the pushing roller 85. Further, the pushing roller 85 includes a columnar core metal 85A having its axial direction in the Z direction, and a sponge layer 85B formed on the outer peripheral surface of the core metal 85A. The core metal 85A is rotatably supported by a bearing (not shown).

The pushing roller 85 presses the pressing belt 83 and the fixing belt 36 toward the pad 42 by a pushing force of the spring member 86, and hence forms a second press region N2. As described above, even if the forming member includes the rotational body and the spring, the total width of the width L1 and the width L2 is increased without excessive depression of the pressing roller 84. In the fixing device 80, the diameter of the pressing roller 84 is smaller than the diameter of the pressing roller 58 (see FIG. 2). As long as the diameter of the pressing roller 84 is decreased, the curvature radius of the pressing belt 83 wound around the pressing roller 84 is increased. Accordingly, the exit of the nip part N is widened, and the sheet P is peeled with ease.

Second Modification

Figure 6:
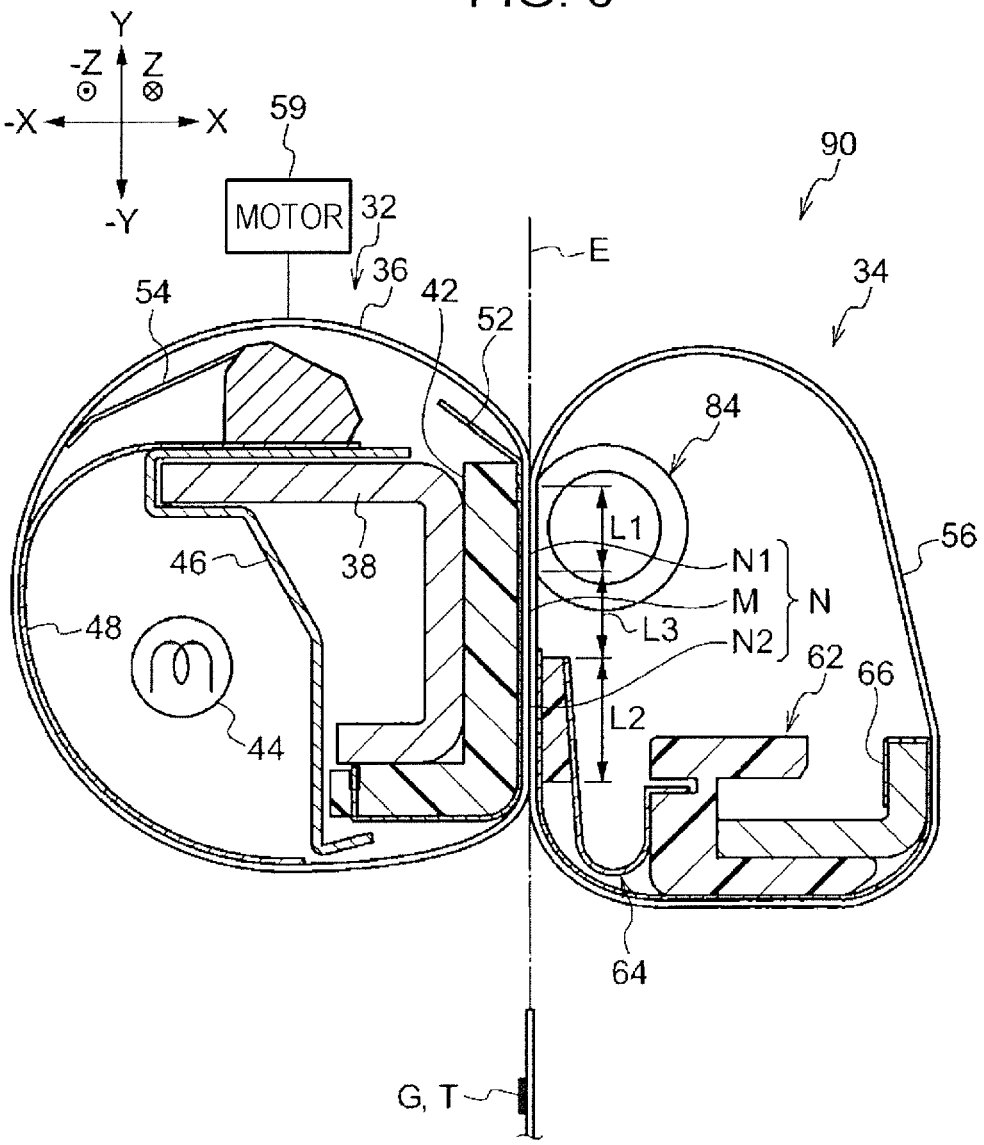
FIG. 6 is an explanatory view showing a configuration of a fixing device according to a second modification.

FIG. 6 illustrates a fixing device 90 according to a second modification. The fixing device 90 differs from the fixing device 30 (see FIG. 2) according to the first exemplary embodiment in that a pressing roller 84 is provided in the pressing unit 34 (see FIG. 2) instead of the pressing roller 58 (see FIG. 2). Also, caps having shaft portions (not shown) are fitted on both end portions in the Z direction of the fixing belt 36, and the shaft portions are rotated by the motor 59. The pressing roller 84 is rotated by the movement of the fixing belt 36 and the pressing belt 56. As described above, even if the pressing belt 83 is not wound around the outer peripheral surface of the pressing roller 84 except the first press region N1 while the pressing roller 84 forms the first press region N1, the total width of the width L1 and the width L2 is increased without excessive depression of the pressing roller 84.

Third Modification

Figure 7:
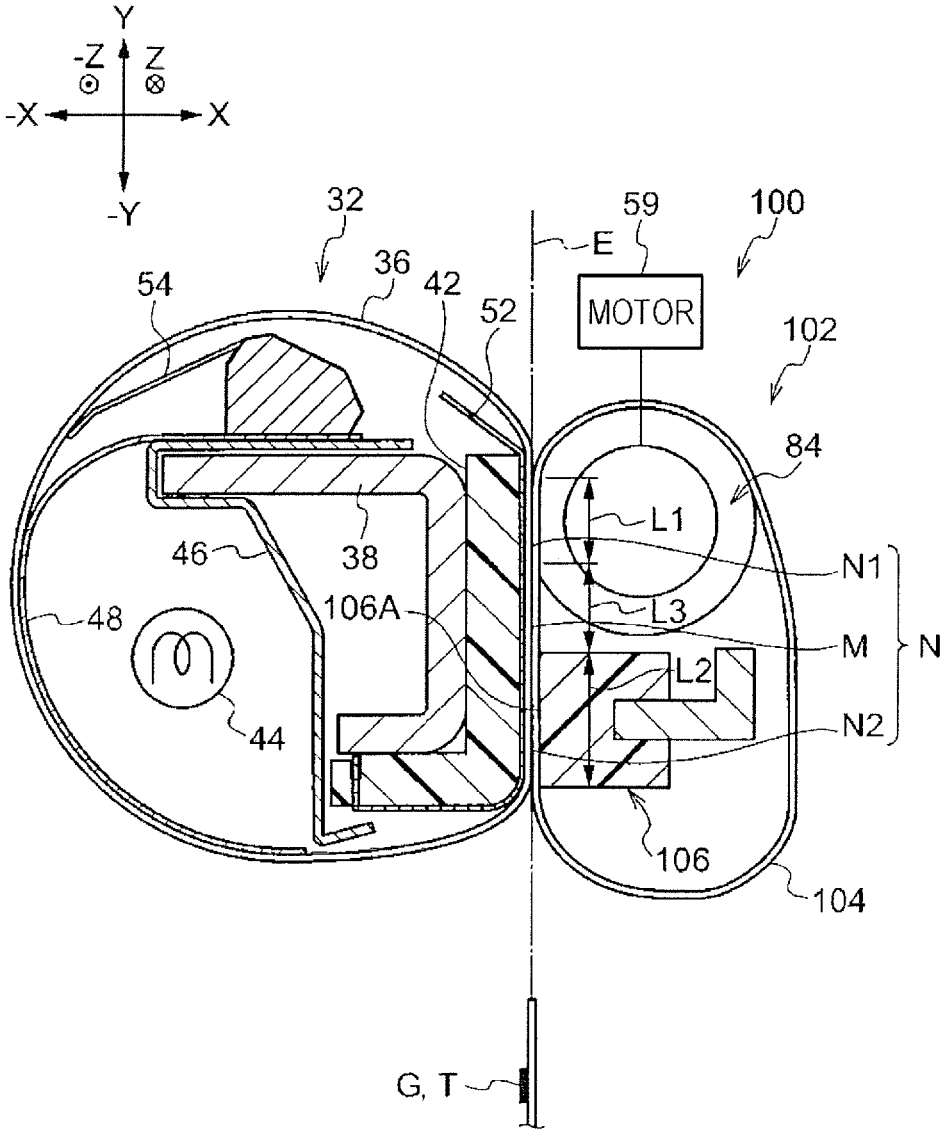
FIG. 7 is an explanatory view showing a configuration of a fixing device according to a third modification.

FIG. 7 illustrates a fixing device 100 according to a third modification. The fixing device 100 differs from the fixing device 30 (see FIG. 2) according to the first exemplary embodiment in that a pressing unit 102 is provided instead of the pressing unit 34 (see FIG. 2). The pressing unit 102 includes a pressing belt 104, the pressing roller 84, the motor 59, and a forming member 106. The pressing belt 104 is an example of a second belt.

The pressing belt 104 is configured similarly to the above-described pressing belt 56 (see FIG. 2). However, the pressing belt 104 has a smaller peripheral length than that of the pressing belt 56. Also, the pressing belt 104 forms a nip part N at which the pressing belt 104 sandwiches the sheet P with the fixing belt 36. The pressing roller 84 according to the third modification has a larger diameter than that of the pressing roller 84 according to the second modification. The pressing belt 104 is wound around a portion of the outer peripheral surface of the pressing roller 84 except the first press region N1.

The forming member 106 is arranged inside the pressing belt 104, at the −Y side (the upstream side in the transport direction of the sheet P). Also, the forming member 106 is made of resin and formed in a rectangular-parallelepiped shape having its longitudinal direction in the Z direction. The forming member 106 has a side surface 106A along a Y-Z plane. The side surface 106A is in contact with the inner peripheral surface of the pressing belt 104 in the nip part N. The forming member 106 presses the pressing belt 104 and the fixing belt 36 toward the pad 42 without a pushing force by a spring but by managing the arrangement, and hence forms a second press region N2. As described above, even if the second press region N2 is formed by the forming member 106 without a spring or the like, the total width of the width L1 and the width L2 is increased without excessive depression of the pressing roller 84.

Fourth Modification

Figure 8:
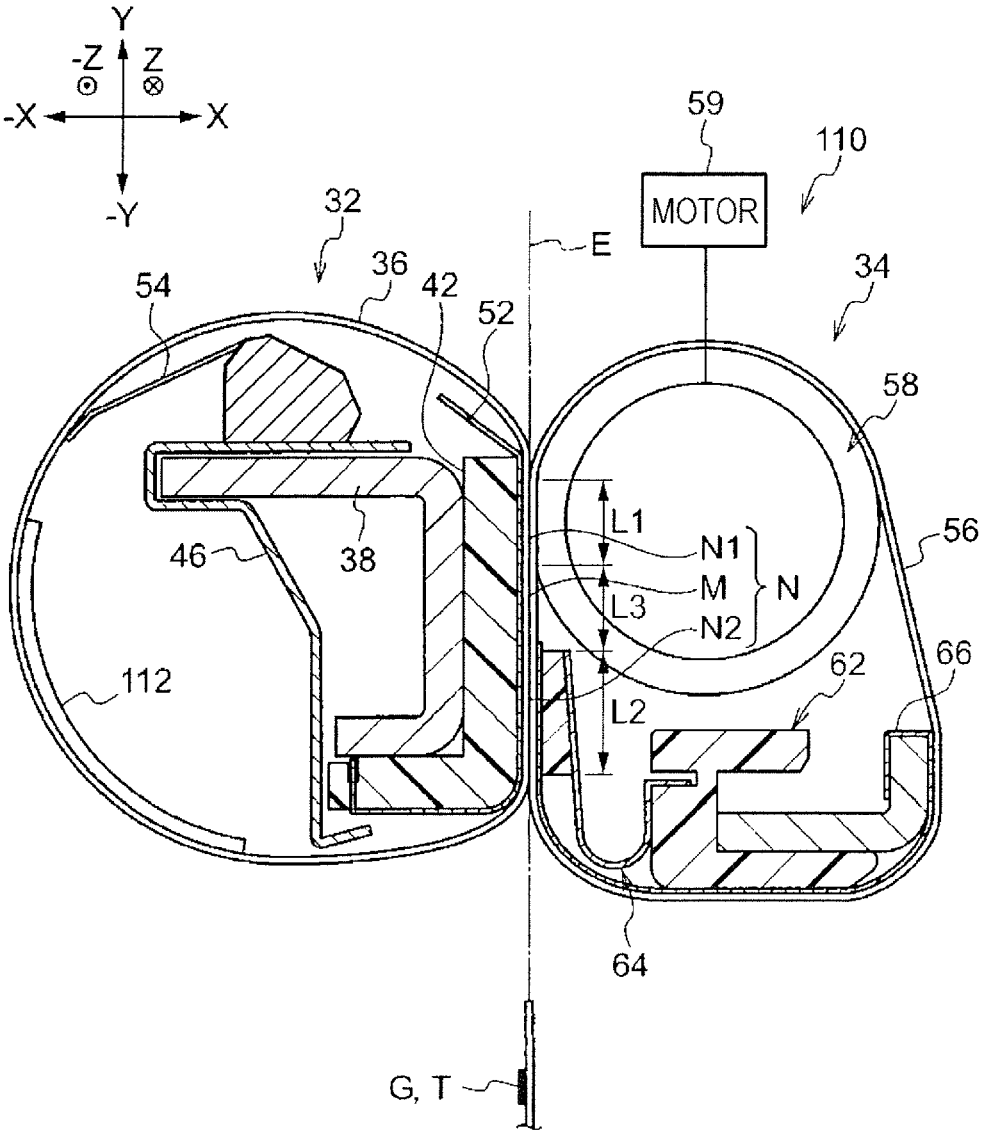
FIG. 8 is an explanatory view showing a configuration of a fixing device according to a fourth modification.

FIG. 8 illustrates a fixing device 110 according to a fourth modification. The fixing device 110 differs from the fixing device 30 (see FIG. 2) according to the first exemplary embodiment in that a planar heating element 112 is provided instead of the halogen lamp 44 (see FIG. 2). Also, the fixing belt 36 includes a base layer made of nickel. The planar heating element 112 is in contact with a portion of the inner peripheral surface of the fixing belt 36 opposite to the nip part N side. Also, the planar heating element 112 generates heat by energization from a power supply (not shown), and heats the fixing belt 36. As described above, the heating unit of the fixing belt 36 is not limited to the halogen lamp 44, and may be the planar heating element.

Fifth Modification

Figure 9:
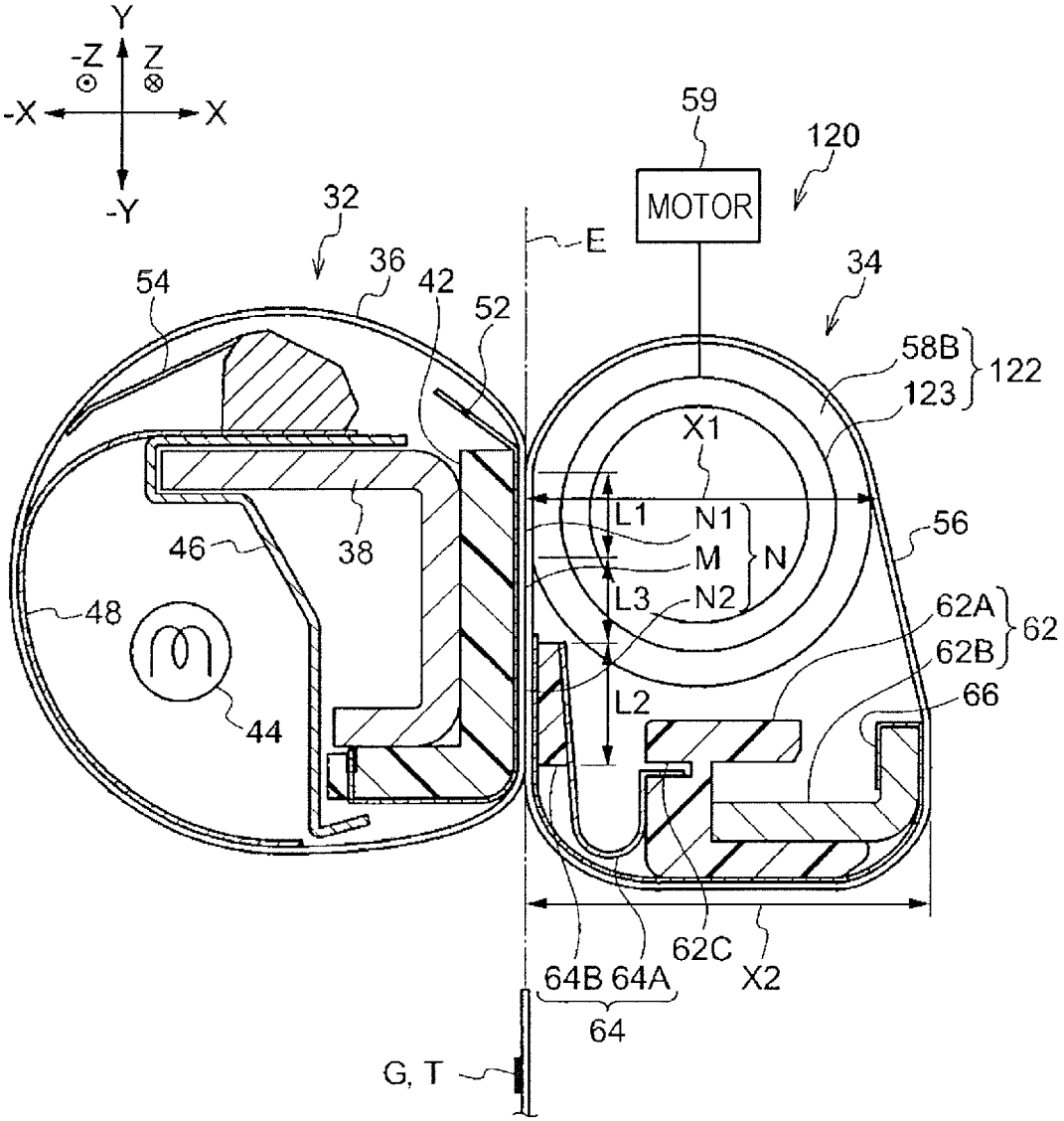
FIG. 9 is an explanatory view showing a configuration of a fixing device according to a fifth modification.

FIG. 9 illustrates a fixing device 120 according to a fifth modification being a modification of the fixing device 30 (see FIG. 2) according to the first exemplary embodiment.

The fixing device 120 includes a pressing roller 122 instead of the pressing roller 58 (see FIG. 2) in the fixing device 30 (see FIG. 2). The other configuration except the pressing roller 122 is similar to the configuration of the fixing device 30.

The pressing roller 122 is arranged at a position to face a portion located downstream of the center of the pad 42 in the Y direction, to have its axial direction in the Z direction. Also, the pressing roller 122 includes a cylindrical core metal 123 being an example of a shaft portion, and the elastic layer 58B formed on the outer peripheral surface of the core metal 123. Both end portions in the axial direction of the core metal 123 are rotatably supported by bearings mounted on brackets (not shown). In this way, the pressing roller 122 is a roller in which the rotating core metal 123 is hollow when viewed in the Z direction.

The core metal 123 is pushed by a spring (not shown) toward the pressing belt 56 so that the outer peripheral surface of the elastic layer 58B contacts the inner peripheral surface of the pressing belt 56 and hence forms a first press region N1. As described above, the pressing roller 122 is provided rotatably around the Z direction as its rotational axis, presses the pressing belt 56 and the fixing belt 36 toward the pad 42, and hence forms the first press region N1. The motor 59 is connected with one end portion in the Z direction of the core metal 123 through a gear (not shown) and hence rotates the pressing roller 122 around the axis.

In the fixing device 120, the second press region N2 having the larger width in the Y direction than the width of the first press region N1 using the pressing roller 122 is arranged at the upstream side of the nip portion N. Hence, the total width of the width L1 and the width L2 is increased by the second press region N2 using the forming member 64, without excessive depression of the elastic layer 58B of the pressing roller 122 in the first press region N1. That is, the total width of the first press region N1 and the second press region N2 is increased without excessive depression of the pressing roller 122 as compared with the configuration in which the width L2 is smaller than the width L1 in the Y direction.

Further, in the fixing device 120, the core metal 123 of the pressing roller 122 is hollow. Hence, in the fixing device 120, the thermal capacity of the pressing roller 122 is decreased as compared with a configuration in which a pressing roller has a solid core metal. The heat of the fixing belt 36 is prevented from being removed by the pressing roller.

Other Modifications

With the combination of the pressing roller and the pad, the distance between the members is decreased as compared with the combination of the pressing roller and the pushing roller, and hence the fixing device may be decreased in size. In this way, by arranging the first press region N1 and the second press region N2 close to each other, the intermediate region M may be eliminated. Also, the second press region N2 may be formed of plural forming members arranged in the transport direction of the sheet P.

The configuration of each fixing device is not limited to the configuration in which the pressing roller 58 is rotated (driven) by the motor 59. For example, caps may be fitted on both end portions in the Z direction of the fixing belt 36 like the fixing device 90, and the caps may be rotated by the motor.

The pad portion 64B may be pushed to the pressing belt 56 by providing a rubber member instead of the leaf spring portion 64A.

The heating unit of the fixing belt 36 is not limited to the halogen lamp 44 or the planar heating element 112. For example, a heat generating layer made of metal may be provided at the fixing belt 36, and the heat generating layer may generate heat by an electromagnetic induction effect of a magnetic field generated by energization to a coil.

Oil or grease may be applied to the inner peripheral surface of the fixing belt 36, and the inner peripheral surface of the pressing belt 56, 83, or 104.

In the fixing device 70, the pressing roller 58 may be replaced with the pressing roller 122.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a first belt configured to heat a developer image on a recording medium;

a support member that is arranged inside the first belt and supports the first belt;

a second belt configured to sandwich the recording medium with the first belt;

a pressing roller that is provided with the second belt having an inner peripheral surface wound around the pressing roller, is provided rotatably in a direction orthogonal to a transport direction of the recording medium as an axial direction, and is configured to press the second belt and the first belt toward the support member, and hence forming a first press region; and a forming member that is provided inside the second belt, at an upstream side in the transport direction with respect to the pressing roller, is configured to press the second belt and the first belt toward the support member, and hence forming a second press region having a larger width than a width of the first press region in the transport direction, wherein the transport direction is substantially straight through at least one of the first press region and the second press region.

2. The fixing device according to claim 1, further comprising:

a driving source configured to rotate the pressing roller, wherein a length by which the second belt is wound around the pressing roller in a circumferential direction of the pressing roller is at least about ½ of a peripheral length of the pressing roller.

3. The fixing device according to claim 2, wherein the pressing roller includes a hollow shaft portion.

4. The fixing device according to claim 1, wherein the pressing roller includes a hollow shaft portion.

5. An image forming apparatus comprising:

a developer image forming unit configured to form a developer image on a recording medium; and the fixing device according to claim 1 configured to fix the developer image formed on the recording medium by the developer image forming unit, to the recording medium.

6. The fixing device according to claim 1, wherein the support member comprises a pad which is substantially straight through a portion of the transport direction at which the first press region and the second press region are arranged.

7. The fixing device according to claim 1, wherein the forming member comprises a pushing roller, and a radius of the pushing roller is larger than a radius of the pressing roller.

8. The fixing device according to claim 1, wherein the second belt is provided in contact an outer circumference of the pressing roller, and wherein less than half of the outer circumference of the pressing roller is in contact with the second belt.

9. The fixing device according to claim 1, wherein the forming member comprises resin and is formed in a rectangular-parallelepiped shape.

10. The fixing device according to claim 1, further comprising:

a planar heating element configured to heat the first belt, wherein the first belt comprises a base layer of nickel.

* * * * *